United States Patent [19]

Marker, III

[11] Patent Number: 4,515,490

[45] Date of Patent: May 7, 1985

[54] COMPUTER PRINTER STAND WITH MULTIPLE PAPER WEB GUIDE SLOTS

[76] Inventor: Franklin Marker, III, 28 Cooper, Houston, Tex. 77076

[21] Appl. No.: 574,414

[22] Filed: Jan. 27, 1984

[51] Int. Cl.[3] ..... B41J 15/04

[52] U.S. Cl. ..... 400/613.2; 312/349; 312/350; 226/196; 270/52

[58] Field of Search ..... 400/605–609, 400/611, 613.2; 312/40, 211, 283, 349, 350; 226/108–109, 196; 270/52

[56] References Cited

U.S. PATENT DOCUMENTS

| | | | |
|---|---|---|---|
| 2,348,059 | 5/1944 | Daly | 400/613.2 |
| 2,440,302 | 4/1948 | Sherman | 400/613.2 |
| 2,904,332 | 9/1959 | Metzner | 270/52 |
| 4,059,256 | 11/1977 | Palmer | 270/52 |
| 4,408,916 | 10/1983 | Burgert | 400/613.2 |

FOREIGN PATENT DOCUMENTS

| | | | |
|---|---|---|---|
| 1296148 | 5/1969 | Fed. Rep. of Germany | 400/606 |
| 28394 | 2/1983 | Japan | 400/613.2 |
| 1132839 | 11/1968 | United Kingdom | 270/52 |
| 1157656 | 7/1969 | United Kingdom | 400/609 |

*Primary Examiner*—E. H. Eickholt

*Attorney, Agent, or Firm*—Neal J. Mosely

[57] ABSTRACT

A stand is provided for supporting a printer for a computer, or word processor, or the like, which provides for feeding sheet or web stock from plurality of separate storage boxes or containers. A printer is supported on the top shelf of the stand. The stand stores boxes or containers of printing sheet or web stock on continuous form on two lower shelves thereof and feeds the continuous strip material alternately from the boxes or containers on the shelves as required by the printer. The top shelf has a plurality of guide slots, one for each of the boxes or containers of printing stock. A plurality of guide plates are provided in association with respective ones of said guide slots and in association with the intermediate shelf to guide printing stock from said boxes or containers to the printer. The upper ends of the printing stock not in use are folded over the ends of the guide plates extending above the top shelf. An angularly oriented storage tray is supported above the rear end of the top shelf to receive printed output from the printer.

11 Claims, 2 Drawing Figures

COMPUTER PRINTER STAND WITH MULTIPLE PAPER WEB GUIDE SLOTS

BACKGROUND OF THE INVENTION

1. Field of the Invention

This invention relates to new and useful improvements in printer stands and more particularly to a stand for a computer or word processor, or the like, for supporting a printer, storing prefolded continuous printing stock, feeding printing stock to the printer, and collecting printed output.

2. Brief Description of the Prior Art

The advent of the computer created a need for stand-alone printers. Prefolded paper, sometimes referred to as continuous recording web or printing stock, is used with computer printers to provide continuous paper feed. Commonly, different types of continuous printing stock are required to meet the differing needs of a business. Changing the printing stock used by the printer typically involves the physical removal of the printing stock and/or the container holding the same to a storage area and the transportation of the replacement web to the printer. This results wasted time and effort in replacing continuous printing stock.

Jensen U.S. Pat. No. 1,791,212 discloses a device to equip a duplicating machine with a web-control device to stretch continuous multi-strip stationary across the platen.

Bezold U.S. Pat. No. 1,996,636 discloses a device for creating tension in continuous length stationery to uniformly and tautly present paper to a typewriter platen.

Davidson U.S. Pat. No. 2,851,267 discloses a strip feeding device for dispensing paper to an addressograph machine. The device disclosed does not provide a system for storing more than two types of recording web and is not adaptable to the requirements of modern stand-alone printers.

House U.S. Pat. No. 3,276,706 discloses a dispenser for dispensing roll materials.

Palmer U.S. Pat. No. 4,059,256 discloses a system for storing multiple containers of printing web and for feeding the web to a printer. The system disclosed does not contemplate an integral system for supporting the printer, storing various types of web, feeding the web to the printer and collecting the printed output.

Estabrooks U.S. Pat. No. 4,252,453 discloses a printer with a noise attenuating system. The printer disclosed includes a single container of recording web fed into a paper inlet on the bottom of the printer and includes a web collection receptacle at the rear of the printer. The system does not provide for the storage and feeding of multiple types of recording web and is not adaptable to modern portable printers which have paper inlets on the top and at the rear of the printer.

SUMMARY OF THE INVENTION

It is therefore an object of this invention to provide a new and improved apparatus and system for supporting a printer, storing continuous recording web or printing stock of various types and sizes, feeding printing stock to the printer and collecting the printed output.

Another object of the invention is to provide a new and improved apparatus and system to feed various types and sizes of continuous printing stock to a printer without the necessity of relocating the containers of printing stock each time a different type is needed.

Still another object of the invention is to provide a new and improved printer stand having means to feed various types and sizes of continuous printing stock to a printer without the necessity of relocating the containers of printing stock each time a different type is needed.

Yet another object of the invention is to provide a new and improved printer stand having a storage shelf for the printer, separate storage shelves for different types and sizes of printing stock, and means to feed the various types and sizes of continuous printing stock to a printer without the necessity of relocating the containers of printing stock each time a different type is needed.

Other objects of the invention will become apparent from time to time throughout the specification and claims as hereinafter related.

The above stated objects and other objects of the invention are accomplished by a stand for supporting a printer for a computer, or word processor, or the like. The stand provides for feeding continuous sheet or web stock from plurality of separate storage boxes or containers. A printer is supported on the top shelf of the stand. The stand stores boxes or containers of printing sheet or web stock on continuous form on two lower shelves thereof and feeds the continuous strip material alternately from the boxes or containers on the shelves as required by the printer. The top shelf has a plurality of guide slots, one for each of the boxes or containers of printing stock. A plurality of guide plates are provided in association with respective ones of said guide slots and in association with the intermediate shelf to guide printing stock from said boxes or containers to the printer. The upper ends of the printing stock not in use are folded over the ends of the guide plates extending above the top shelf. An angularly oriented storage tray is supported above the rear end of the top shelf to receive printed output from the printer.

DESCRIPTION OF THE PREFERRED EMBODIMENT

Figure 1:
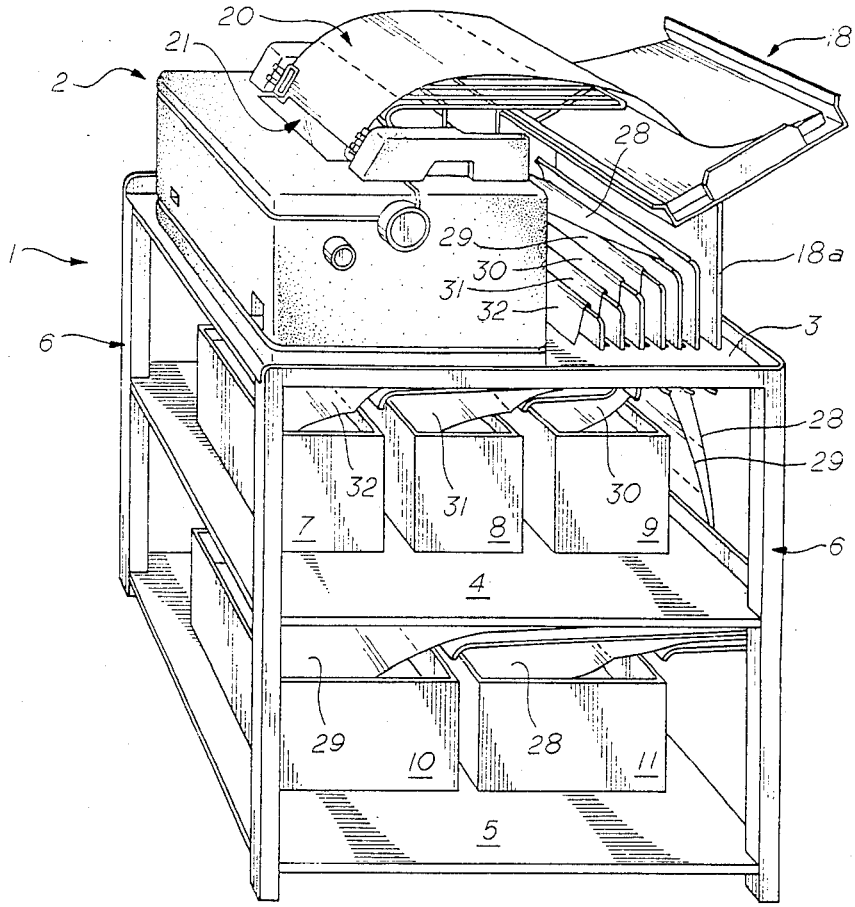
FIG. 1 is an isometric view of a printer stand illustrating one embodiment of the invention.
Figure 2:
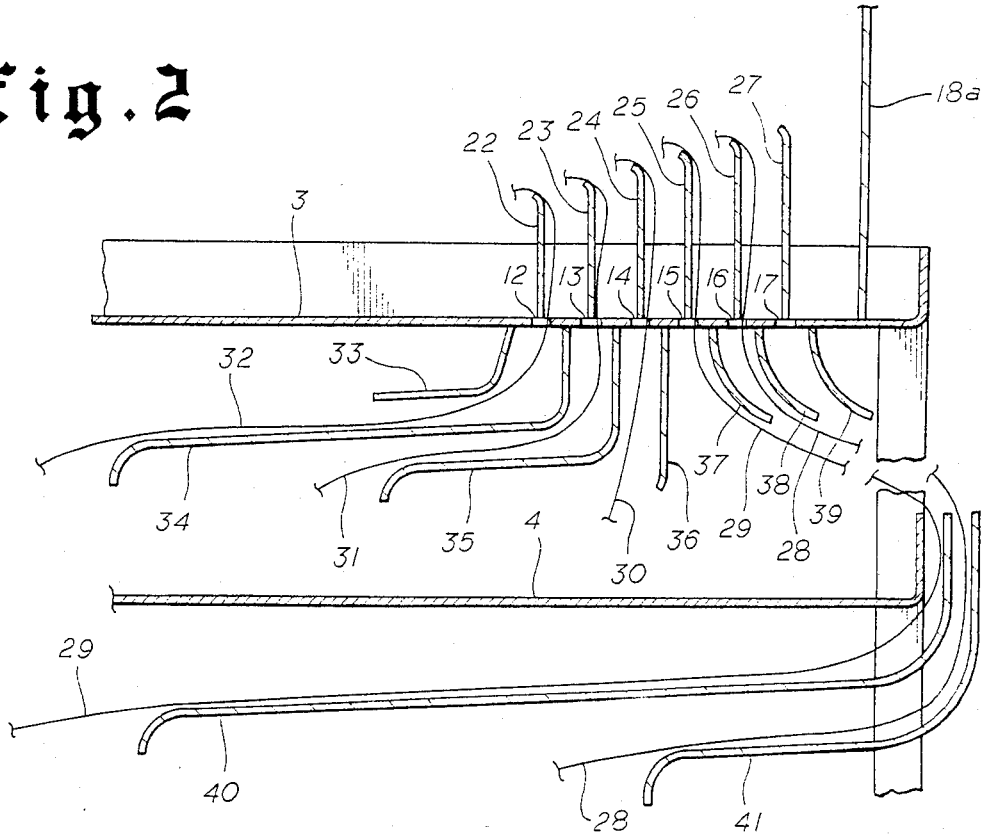
FIG. 2 is a detail of the paper guide plates extending upward and downward from the top shelf and generally in a horizontal direction below the middle shelf.

Referring to the drawings by numerals of reference, and more particularly to FIG. 1, there is shown a preferred embodiment of the invention which consists of a stand 1 supporting a printer 2. The stand has a horizontal top shelf 3 which supports printer 2 and two lower shelves 4 and 5 spaced below the top shelf and parallel thereto. The shelves 3, 4 and 5 are spaced a sufficient distance from each other to allow storage of containers for prefolded recording web or printing stock on the lower shelves 4 and 5. The shelves are supported at their corners by vertical leg members 6. Leg members 6 are of square metal tubing, or the like, and may be provided with casters (not shown) for ease of movement of the stand. The shelves may be of any suitable sheet material, but sheet metal is preferred, with reinforced edges secured at their corners to the vertical leg tubing members.

Containers or boxes 7, 8, 9, 10 and 11 containing different sizes and/or types of prefolded continuous recording web or printing stock are located on shelves 4 and 5. The containers are positioned substantially parallel to each other and to the paper inlet 19 of the printer so that the continuous printing stock may be fed from any selected container or box to the printer. The table is illustrated as providing for the separate feeding from five boxes or containers of continuous printing stock. Obviously, the stand could be modified to accomodate a larger variety of stock. A smaller number of boxes of continuous printing stock can be handled on the embodiment described herein.

The top shelf 3 has five slots 12, 13, 14, 15 and 16 located in and through the top shelf 3 parallel to the paper inlet 19 of the printer 2. The slots 12–16 are located behind the area of the top shelf 3 occupied by printer 2. The slots 12–16 are of sufficient length and width to allow any of the various sizes and/or types of continuous feed recording web or printing stock to pass through unobtructed. A storage tray 17 is supported above the top shelf 3 by a vertical support 18. The receptacle is of sufficient length, width and depth to contain the printed stock 20 discharged from the paper outlet 21 of printer 2.

The top shelf 3 has a plurality of guide members extending upward therefrom adjacent to the slots 12–16. The guide members comprise a plurality of plate members 22, 23, 24, 25, 26 and 27 of graduated length and slightly curved at their upper ends. The guide members 22–27 are centered in the respective slots 12–16. The guide members maintain separation of the respective continuous printing stock or recording web from the various boxes or containers 7–11 as it passes through the slots 12–16.

The boxes or containers 7–11 each contain a different size and/or type of printing stock or recording web 28, 29, 30, 31 and 32 (FIG. 1). When a particular size or type of recording web is not in use, it may be folded over the adjacent guide member to prevent the end of the web from sliding through the slots. The curved upper ends of the guide members guides the printing stock more smoothly and restrains the ends from falling through the slots when not in use. As previously noted, the guide members are graduated in length, with the shortest guide member closest to the printer, to permit convenient access to the ends of the printing stock or recording web.

A plurality of guide plates are positioned below the level of the top shelf 3 to guide the flow of recording web or printing stock from the boxes or containers to the guide slots 12–16. Guide members 33, 34, 35, 36, 37, 38 and 39 extend below the top shelf 3 of the stand adjacent and parallel to the slots 12–16. The guide members 33–39 are located between each of the slots 12–16 and on the outside of the outermost slots 12 and 16. Guide members 33, 34 and 35 are curved toward the front end of the stand, i.e. beneath the printer 2, and guide members 37, 38 and 39 are curved toward the opposite end of the stand. Guide members 34 and 35 extend over boxes or containers 7 and 8 while guide member 36 extends downward toward box or container 9. Guide members 40 and 41 are supported at the back of the stand on legs 6 and extend below shelf 4 to a position over boxes or containers 10 and 11. The rear end portions of guide members 40 and 41 curve upward and are spaced to keep the printing stock separated for feeding to the printer.

OPERATION

The containers or boxes 7–11 are stored on shelves 4 and 5 as shown in FIG. 1. Recording web or printing stock 28 is fed from box 11 between guides 40 and 41, and then upward between guide members 38 and 39 and through slot 16. Above slot 16, recording web or printing stock 28 passes between guide members 26 and 27 and into the inlet 19 to printer 2.

Recording web or printing stock 29 is fed from box 10 over guide 40 and then upward between guide members 37 and 38 and through slot 15. Above slot 15, recording web or printing stock 29 passes between guide members 25 and 26 and is folded over guide member 25 into the other side of slot 15 for temporary storage.

Recording web or printing stock 30 is fed from box 9 between guide members 35 and 36 and through slot 14. Above slot 14, recording web or printing stock 30 passes between guide members 24 and 25 and is folded over guide member 24 into the othr side of slot 14 for temporary storage.

Recording web or printing stock 31 is fed from box 8 between guide members 34 and 35 and through slot 13. Above slot 13, recording web or printing stock 31 passes between guide members 23 and 24 and is folded over guide member 23 into the other side of slot 13 for temporary storage.

Recording web or printing stock 32 is fed from box 7 between guide members 33 and 34 and through slot 12. Above slot 12, recording web or printing stock 32 passes between guide members 22 and 23 and is folded over guide member 22 into the other side of slot 12 for temporary storage.

When it is desired to use a particular type of recording web or printing stock, the end is inserted into the paper inlet 19 of the printer. As information is printed onto the recording web or printing stock, the printed output is discharged from the paper outlet 21 of the printer 2 and is collected in the storage tray 17. When the printing is completed, the end of the recording web or printing stock is detached from printer 2 and again folded over the appropriate guide member until needed again.

While this invention has been described fully and completely with special emphasis upon a single preferred embodiment, it should be understood that, within the scope of the appended claims, this invention may be practiced otherwise than as specifically set forth herein.

I claim:

1. A stand for supporting a printer and containers for different sizes and types of continuous printing stock for feeding the printing stock to the printer comprising:

a plurality of vertically extending legs, a plurality of horizontally positioned shelves supported on said legs in vertically spaced relation, the top shelf having one end portion for supporting a printer, a support member supported on and extending upward from the other end of said top shelf, a tray supported on said support member for receiving and storing printed output from said printer, a plurality of guide slots in said top shelf between said one end portion and said support member, a plurality of plate shaped guide members centered one in each of said guide slots, at least one shelf being positioned below said top shelf to support containers of printing stock in selected positions, and at least some of said guide members extending downwardly below said guide slots to said selected positions above said containers for guiding printing stock through said slots for selective introduction into the printer.

2. A printer stand and printing stock feeding and collecting apparatus according to claim 1 in which said support member comprises a plate member extending upward from said top shelf at said other end, and said tray is supported on the upper end thereof at an angular orientation aligned with the outlet from the printer to receive and store printed output from the printer.

3. A printer stand and printing stock feeding and collecting apparatus according to claim 1 in which:

some of said guide members extend upward from said top shelf between each of said slots and outside the slot nearest the printer in parallel reation to said slots to maintain separation of printing stock passing through the slots and to secure ends of printing stock in place by folding thereover when not in use.

4. A printer stand and printing stock feeding and collecting apparatus according to claim 3 in which said upwardly extending guide members are graduated in height with the shortest one closest to the printer and successive guide members being progressively longer to provide convenient access to ends of the printing printing stock.

5. A printer stand and printing stock feeding and collecting apparatus according to claim 1 in which said downwardly extending guide members are positioned between the slots in the top shelf and outside the outermost slots and are parallel to said slots and extend down from the top shelf to provide a means of separating and guiding printing stock passing through the slots, said downwardly extending guide members being of varying lengths and being inclined in selected directions for directing printing stock from selected containers on said lower shelf.

6. A printer stand and printing stock feeding and collecting apparatus according to claim 1 in which there are two lower shelves spaced vertically at selected distances permitting storage of a plurality of printing stock containers at selected positions on each shelf, said downwardly extending guide members extending to selected positions over containers stored on the upper one of said two lower shelves, and a plurality of plate shaped guide members extending from said other end toward said one end above the bottom shelf to a position above containers of printing stock supported thereon to guide printing stock to selected ones on said downwardly extending guide members and the slots associated therewith.

7. A printer stand and printing stock feeding and collecting apparatus according to claim 1 in which said support member comprises a plate member extending upward from said top shelf at said other end, said tray is supported on the upper end thereof at an angular orientation aligned with the outlet from the printer to receive and store printed output from the printer, and some of said guide members extend upward from said top shelf between each of said slots and outside the slot nearest the printer in parallel relation to said slots to maintain separation of printing stock passing through the slots and to secure ends of printing stock in place by folding thereover when not in use.

8. A printer stand and printing stock feeding and collecting apparatus according to claim 1 in which said support member comprises a plate member extending upward from said top shelf at said other end, said tray is supported on the upper end thereof at an angular orientation aligned with the outlet from the printer to receive the store printed output from the printer, some of said guide members extend upward from said top shelf between each of said slots and outside the slot nearest the printer in parallel relation to said slots to maintain separation of printing stock passing through the slots and to secure ends of printing stock in place by folding thereover when not in use, and said upwardly extending guide members being graduated in height with the shortest one closest to the printer and successive guide members being progressively longer to provide convenient access to ends of the printing printing stock.

9. A printer stand and printing stock feeding and collecting apparatus according to claim 1 in which:

said support member comprises a plate member extending upward from said top shelf at said other end, said tray is supported on the upper end thereof at an angular orientation aligned with the outlet from the printer to receive and store printed output from the printer, some of said guide members extend upward from said top shelf between each of said slots and outside the slot nearest the printer in parallel relation to said slots to maintain separation of printing stock passing through the slots and to secure ends of printing stock in place by folding thereover when not is use, said upwardly extending guide members being graduated in height with the shortest one closest to the printer and successive guide members being progressively longer to provide convenient access to ends of the printing printing stock, said downwardly extending guide members are positioned between the slots in the top shelf and outside the outermost slots and are parallel to said slots and extend down from the top shelf to provide a means of separating and guiding printing stock passing through the slots, and said downwardly extending guide members being of varying lengths and being inclined in selected directions for directing printing stock from selected containers on said lower shelf.

10. A printer stand and printing stock feeding and collecting apparatus according to claim 1 in which said support member comprises a plate member extending upward form said top shelf at said other end, said tray is supported on the upper end thereof at an angular orientation aligned with the outlet from the printer to receive and store printed output from the printer, some of said guide members extend upward from said top shelf between each of said slots and outside the slot nearest the printer in parallel relation to said slots to maintain separation of printing stock passing through the slots and to secure ends of printing stock in place by folding thereover when not in use, said upwardly extending guide members being graduated in height with the shortest one closest to the printer and successive guide members being progressively longer to provide convenient access to ends of the printing printing stock, said downwardly extending guide members are positioned between the slots in the top shelf and outside the outermost slots and are parallel to said slots and extend down from the top shelf to provide a means of separating and guiding printing stock passing through the slots, said downwardly extending guide members being of varying lengths and being inclined in selected directions for directing printing stock from selected containers on said lower shelf, said shelves including two lower shelves spaced vertically at selected distances below said top shelf for storage of a plurality of printing stock containers at selected positions on each lower shelf, said downwardly extending guide members extending to selected positions over containers stored on the upper one of said two lower shelves, and a plurality of plate shaped guide members extending from said other end toward said one end above the bottom shelf to a position above containers of printing stock supported thereon to guide printing stock to selected ones on said downwardly extending guide members and the slots associated therewith.

11. A printer stand and printing stock feeding and collecting apparatus according to claim 1 further including casters positioned on the bottom of said legs for ease of movement.

* * * * *